US005653429A

United States Patent [19]

Michalik et al.

[11] Patent Number: 5,653,429

[45] Date of Patent: Aug. 5, 1997

[54] CYLINDER FOLDING APPARATUS

[75] Inventors: Horst Bernhard Michalik, Höchberg; Otto Theodor Weschenfelder, Würzburg, both of Germany

[73] Assignee: Koenig & Bauer Aktiengesellschaft, Wurzburg, Germany

[21] Appl. No.: 361,575

[22] Filed: Dec. 22, 1994

[30] Foreign Application Priority Data

Dec. 24, 1993 [DE] Germany ..... 43 44 622.1

[51] Int. Cl.[6] ..... B41F 13/58; B41F 13/56

[52] U.S. Cl. ..... 270/8; 270/21.1; 270/38; 270/49; 270/50; 493/426

[58] Field of Search ..... 270/6, 8, 19, 21.1, 270/20.1, 38, 47, 48, 49, 50; 493/406, 426, 427, 429, 474

[56] References Cited

U.S. PATENT DOCUMENTS

| | | | |
|---|---|---|---|
| 1,499,106 | 6/1924 | Halliwell | 493/427 X |
| 1,834,665 | 12/1931 | Wood | 270/6 |
| 1,970,931 | 8/1934 | Crafts | 270/6 |
| 2,137,978 | 11/1938 | Mills et al. | 270/37 |
| 3,038,719 | 6/1962 | Tyma, Jr. . | |
| 3,337,211 | 8/1967 | Bilane | 493/427 X |
| 3,477,709 | 11/1969 | Neal et al. . | |
| 4,123,048 | 10/1978 | Weschenfelder | 493/431 |
| 4,190,242 | 2/1980 | Bolza-Schunemann | 270/50 |
| 4,279,410 | 7/1981 | Bolzaschunemann . | |
| 4,496,338 | 1/1985 | Michalik | 493/426 X |
| 4,936,561 | 6/1990 | Mukai . | |
| 4,974,822 | 12/1990 | Richter | 270/47 X |
| 5,039,076 | 8/1991 | Fischer | 270/47 |

FOREIGN PATENT DOCUMENTS

| | | |
|---|---|---|
| 222671 | 8/1962 | Austria . |
| 0421083 | 4/1991 | European Pat. Off. . |
| 2317545 | 2/1977 | France . |
| 1132935 | 7/1962 | Germany . |
| 2634108 | 3/1979 | Germany . |
| 3217169 | 11/1983 | Germany . |
| 3217169 | 8/1985 | Germany . |
| 3629359 | 5/1987 | Germany . |
| 3821442 | 1/1989 | Germany . |
| 915210 | 1/1963 | United Kingdom . |

*Primary Examiner*—Hoang Nguyen
*Attorney, Agent, or Firm*—Jones, Tullar & Cooper, P.C.

[57] ABSTRACT

A cylinder folding apparatus for a rotary printing press uses a collection and cutting cylinder in cooperation with a solid folding blade cylinder. A paper web train is cut into sections and is folded by transverse folding rollers. The point spur sets on the folding blade cylinder release signatures prior to commencement of the folding procedure. A brush roller is used to maintain contact between the signatures and the folding blade cylinder after release of the point spur set.

3 Claims, 4 Drawing Sheets

CYLINDER FOLDING APPARATUS

FIELD OF THE INVENTION

The present invention is directed generally to a cylinder folding apparatus. More particularly, the present invention is directed to a cylinder folding apparatus for a rotary printing press. Most specifically, the present invention is directed to a cylinder folding apparatus for a web-fed rotary printing press which is operable in collection and double production. The cylinder folding apparatus for a rotary printing press includes a folding drum and a cutting cylinder as well as folding rollers. A paper web anti-deflection guide roller is positioned in the inlet wedge of the cylinder folding apparatus. A brush roller is positioned after, in the direction of rotation of the folding blade cylinder, the two folding rollers.

DESCRIPTION OF THE PRIOR ART

In rotary web-fed printing presses a continuous paper web train, which may have been longitudinally folded, is directed to a folding apparatus. Here the paper web train is cross cut into a plurality of web segments. These segments are then cross folded, by operation of a folding blade, into folded signatures. One prior art cylinder folding apparatus, which is operable in double and collection production, is shown in U.S. Pat. No. 3,038,719. In this device there is provided a 3/3 folding drum with a folding blade support that rotates in an eccentric manner within the folding drum. A 2/2 cutting blade cylinder rotates in cooperation with the folding drum. The folding drum is hollow and subject to large forces due to the cutting forces imparted to it by the cutting blade cylinder. These large cutting forces are apt to create fatigue cracks in the folding drum.

Another limitation of the prior art cylinder folding apparatus is that a number of the components in these devices operate at relatively high spreads of rotation; i.e. high rpm's. These high rotational rates generate high centrifugal forces acting on the folding drum. Consequently, the signatures are pushed out away from the drum into contact with paper guide devices that typically surround the folding drum. This contact between the signatures and the guide devices can result in smearing of the ink on the signatures. In addition, the contact between the signatures and the paper guide devices exerts a braking effect on the signatures. This results in the point spurs, which are used to hold the signatures on the folding drum, causing tears and rips in the edges of the signatures.

It will thus be seen that there is a need for a folding device that overcomes the limitations of the prior art devices. The cylinder folding apparatus in accordance with the present invention provides such a device in a manner which is a significant improvement over the prior art devices.

SUMMARY OF THE INVENTION

It is an object of the present invention to provide a cylinder folding apparatus.

Another object of the present invention is to provide a cylinder folding apparatus for a rotary printing press.

A further object of the present invention is to provide a cylinder folding apparatus for a web-fed rotary printing press and which is operable in collect and double run production.

Yet another object of the present invention is to provide a cylinder folding apparatus having a solid folding cylinder.

Still a further object of the present invention is to provide a cylinder folding apparatus having an inlet paper train guide roller and a brush roller.

Even yet another object of the present invention is to provide a cylinder folding apparatus which is operable in collection production with up to 192 pages without causing damage to the signatures.

As will be discussed in greater detail in the description of the preferred embodiment which is set forth subsequently, the cylinder folding apparatus for a rotary printing press in accordance with the present invention is operable in both collection and double production modes. A folding cylinder assembly cooperates with a cutting cylinder and with folding rollers to cut and fold a paper web train into folded signatures. The cutting blade cylinder also acts as a collection cylinder and is provided with controlled point spurs, as well as with cutting blades. The folding cylinder assembly includes a solid folding cylinder with, point spurs and counter cutting bars. The folding cylinder assembly has one less field on its periphery than does the cutting cylinder. A paper web train anti-deflection guide roller is located in the inlet wedge between the folding cylinder assembly and the cutting cylinder. A brush roller is positioned adjacent the folding cylinder assembly after, in the direction of rotation of the folding cylinder assembly, the second one of the cooperating folding rollers. The cutting blade cylinder has a plurality of circumferentially extending, expandable hoops on its periphery. These hoops are usable to adjust the overall circumferential size of the cutting blade cylinder.

The cylinder folding apparatus in accordance with the present invention overcomes a number of limitations of the prior art devices. Since the folding cylinder is structured as a solid cylinder, it is much more able to withstand the large cutting forces that are imparted to it by the cutting blade cylinder. Both the cutting blade cylinder and the folding cylinder assembly have relatively large diameters and rotate at relatively low speeds. This reduces the centrifugal forces imparted to the signatures and thus does not force the signatures into engagement with the paper guide devices with as much force. Smearing of the ink on the signatures is thus significantly reduced. This ink smearing is prevented even when the cylinder folding apparatus is operating in collect production.

To ease the penetration of the point spur sets disposed on the folding cylinder, during collection production the signatures are pre-pierced by a point spur set disposed on the collection and cutting blade cylinder. This pre-piercing reduces the likelihood of the signatures being ripped or torn.

Before the signatures being carried by the folding cylinder assembly are inserted between the folding rollers by the folding blade to accomplish the transverse folding of the signatures, the points of the point spurs in the folding cylinder have already been retracted beneath the surface of the folding cylinder. The function of holding the signatures against the surface of the folding cylinder, after the point spurs have been retracted, is taken over by the brush roller that is located after the second folding roller. This brush roller rotates counter to the direction of rotation of the folding cylinder and at a higher speed. Thus it is able to maintain the end of the signatures against the folding cylinder. Damage to the ends of the signatures during the folding process is thereby prevented. The cylinder folding apparatus of the present invention is able to produce newspapers or other printed products having a page total of up to 192 pages.

The cylinder folding apparatus for a rotary printing press in accordance with the present invention overcomes the limitations of the prior art devices. It is a substantial advance in the art.

BRIEF DESCRIPTION OF THE DRAWINGS

While the novel features of the cylinder folding apparatus for a rotary printing press in accordance with the present invention are set forth with particularity in the appended claims, a full and complete understanding of the invention may be had by referring to the detailed description of the preferred embodiment which is presented subsequently, and as illustrated in the accompanying drawings, in which:

DETAILED DESCRIPTION OF THE PREFERRED EMBODIMENT

Figure 1:
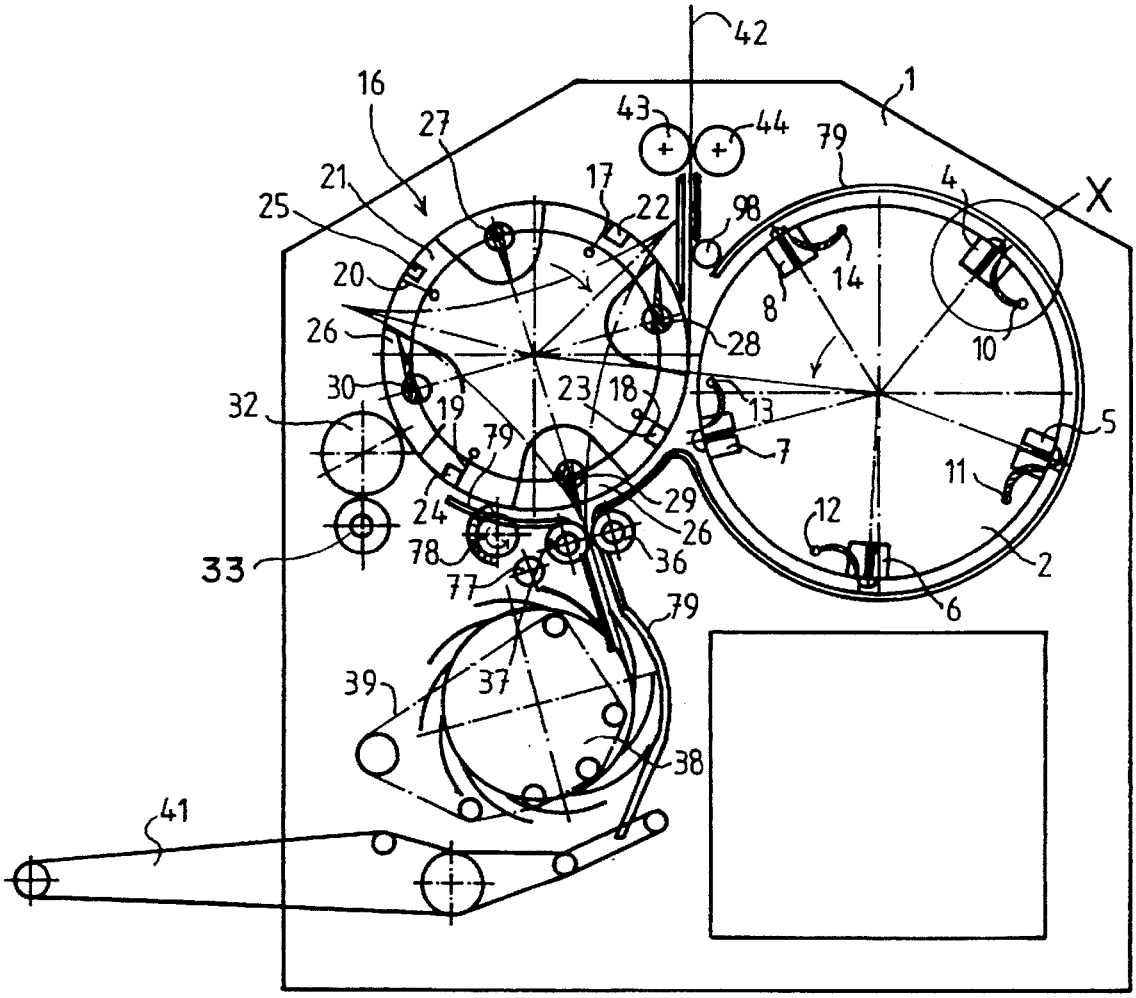
FIG. 1 is a schematic side elevation view of a cylinder folding apparatus for a rotary printing press in accordance with the present invention.

Referring initially to FIG. 1, there may be seen a preferred embodiment of a cylinder folding apparatus for a rotary web-fed printing press in accordance with the present invention. It will be understood that the cylinder folding apparatus is operable with a generally conventional rotary web-fed printing press which forms no part of the present invention and is thus not described or depicted. It will also be understood that the cylinder folding apparatus is usable to receive a printed paper web train from the printing press, to cross cut the paper web into web sections and to impart a transverse or cross fold to each such section and to thereby form the sections into signatures. As will be discussed in detail shortly, the cylinder folding apparatus is able to perform collection and double production.

The cylinder folding apparatus in accordance with the present invention utilizes a 5/2 collection and cutting cylinder 2 which is supported for rotation in a side frame 1 of the printing press and which has a circumference of five section lengths. This cylinder 2 is embodied as a hollow cylinder with five cross braces. Five known cutting bars 4, 5, 6, 7 and 8 with cutters, and five sets of point spurs 10, 11, 12, 13 and 14 which each have a plurality of points and are controlled in a known manner, for example by control cams, are fastened on these cross braces. Elements which are operable for increasing the exterior diameter of the cylinder 2 are fastened on the circumference of the collection and cutting cylinder 2. These elements will be described in detail later. During collection production the point spur sets 10 to 14 of the cutting and collecting cylinder 2 are controlled by fixed cams by means of a driven cover disk. This cover disk is connected with the side frame 1 by a coupling during double production. The coupling can be operated, for example pneumatically, by means of a working cylinder. This operation of the cams and cover disk is generally known and is not shown in the drawings.

Figure 4:
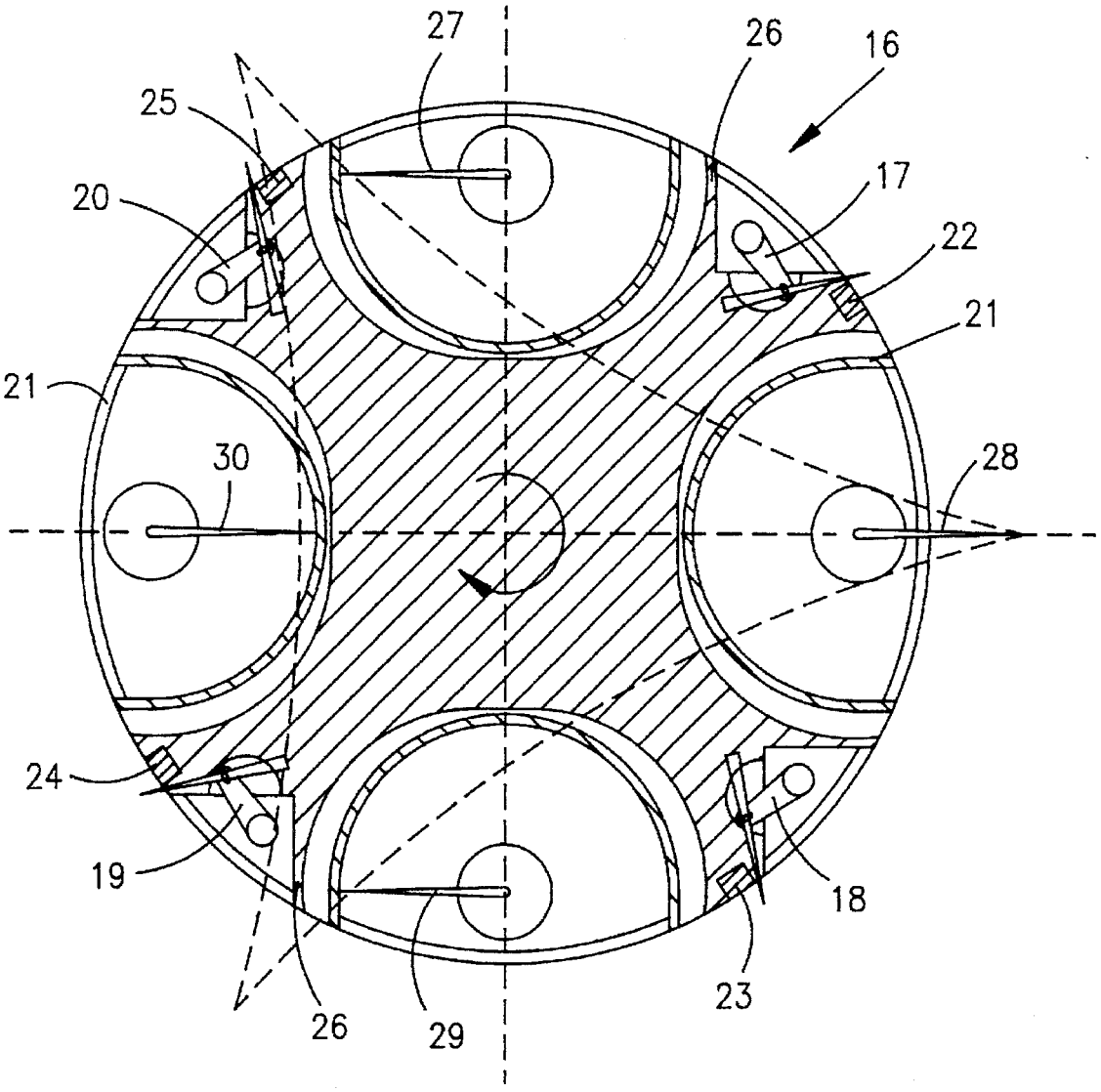
FIG. 4 is a schematic, cross-sectional view of the folding cylinder assembly.

A 4/2 folding, point and counter-cutting-bar cylinder assembly 16, having a circumference of four section lengths, is cooperatively associated with the collection and cutting cylinder 2 and is situated on the left side of the cylinder 2, as seen in FIG. 1. The folding, point and counter-cutting-bar cylinder assembly 16, as may be seen in FIG. 4 consists of two support components that are supported so they can be rotated with respect to each other. These support components are a folding blade support 21 and a solid counter-cutting-bar and point spur set folding cylinder 26. The solid folding cylinder 26 carries four known point spur sets 17, 18, 19 and 20 which are each offset by 90° relative to each other on the cylinder circumference. The folding blade support 21 is similar to the structure shown in FIG. 4 of U.S. Pat. No. 4,279,410.

The point spur sets 17, 19 and 18, 20, which are placed diametrically opposed to each other on the solid folding cylinder 26, are each connected with a control cam. The control cam for the point spur sets 18, 20 can be equipped with a disk to cover the take-over points. This cover disk is turned by means of a working cylinder with a position indicator when production is switched from collection to double production or vice versa. This structure is generally known in the art and is not shown in the drawings. The folding, point and counter-cutting-bar cylinder assembly 16, which is supported for rotation in a clockwise direction has, on its solid folding cylinder 26 and as viewed in the direction of cylinder rotation, a counter-cutting bar 22, 23, 24 or 25 behind each of the point spur sets 17 to 20 and respectively adjoining them, which cooperates with one of the cutter bars 4-8 of the collection and cutting cylinder 2. Four driven, rotating folding blades 27, 28, 29, 30 are rotatably supported by folding blade supports 21 and are positioned in axially extending troughs; in the counter-cutting-bar and point spur set solid folding cylinder 26 of the folding, point spur and counter-cutting-bar cylinder assembly 16. During one rotation of the folding, point spur and counter-cutting-bar cylinder assembly 16, each of the folding blades makes three turns around its axis of rotation.

The adjustment of the folding blade support 21 and the counter-cutting-bar and point spur set solid folding cylinder 26 with respect to each other takes place by a differential gear 32. For this purpose, the solid folding cylinder 26 has a continuous shaft with a gear wheel and the support 21 has a hollow shaft with a gear wheel placed on it. The differential gear 32 is driven by a motor 33 for the purpose of adjusting the time of folding. In this process, the differential gear 32 rotates the folding blade support 21 with respect to the point spur sets 17 to 20 and the adjacent counter-cutting bars 22 to 25 on the counter-cutting bar and the point spur set support folding cylinder 26. The distance between the folding blades 27 to 30 and the point spur sets 17 to 20 can be changed in the course of this adjustment process.

Two cooperating folding rollers 36 and 37, whose spacing from each other can be set in accordance with the thickness of the product to be folded and which are driven and spaced apart from each other, are located below the folding, point spur and counter-cutting-bar cylinder assembly 16, and fold the signatures in cooperation with the folding blades 27 to 30. A paddle wheel 38 with compartments is fixedly secured to the side frame, below these folding rollers 36 and 37, and from which the folded products are placed on an elevator 41 by use of a circulating, endless removal chain 39. A drawing roller group which consists of two drawing rollers 43 and 44, is disposed fixed in the side frame ahead of the inlet for a paper web train 42 into the collection and cutting cylinder 2 or the folding, point spur and counter-cutting-bar cylinder assembly 16. The collection and cutting cylinder 2 can also be designed as a 7/2 cylinder with seven sections, for example seven point spur and cutting systems. The folding, point spur and counter-cutting-bar cylinder assembly 16 can also be designed as a 6/2 cylinder, i.e. with respectively six folding, point spur and groove systems.

Figure 2:
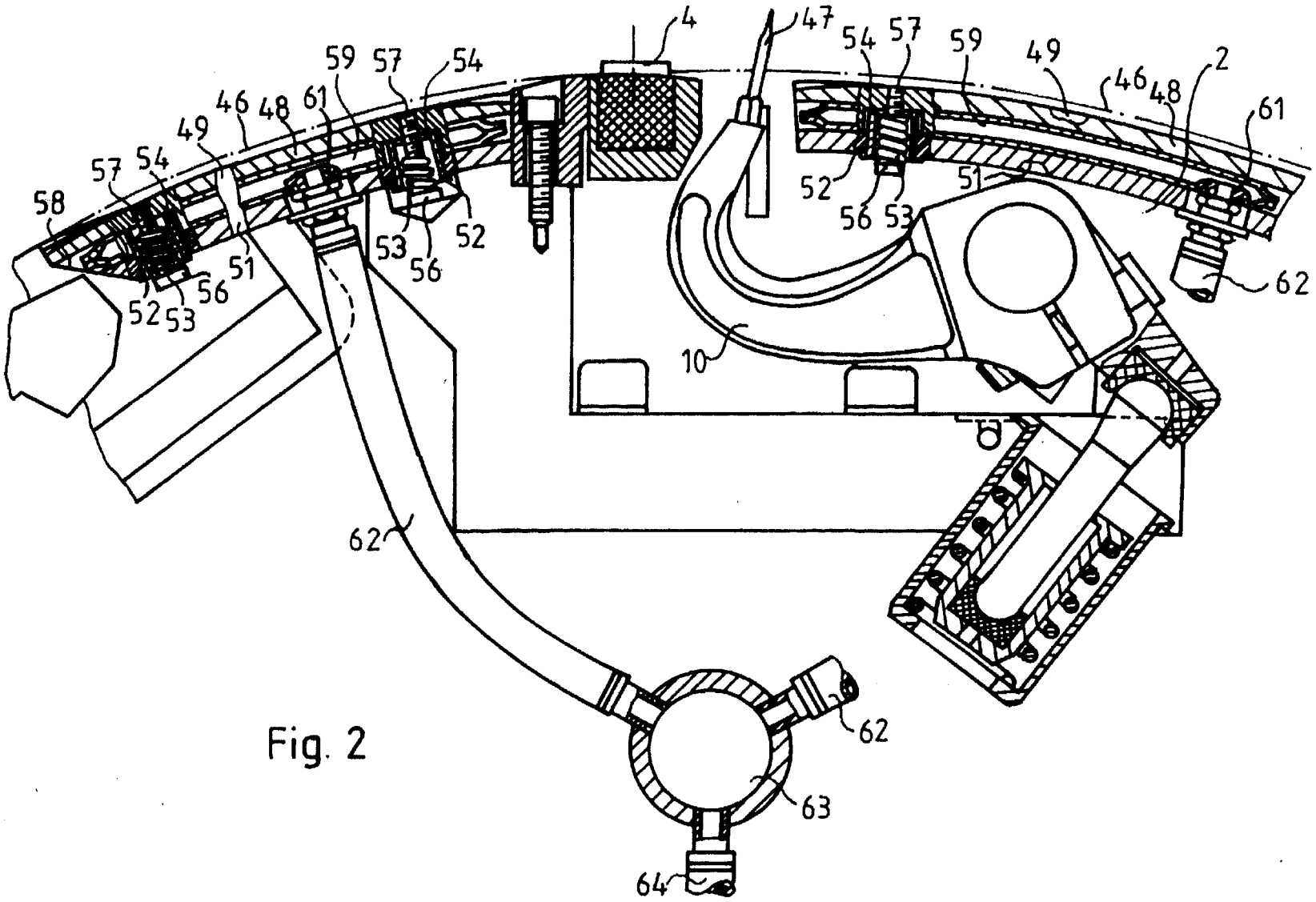
FIG. 2 is an enlarged detail view of a portion of the collection and cutting cylinder of the present invention, as encircled at X in FIG. 1.
Figure 3:
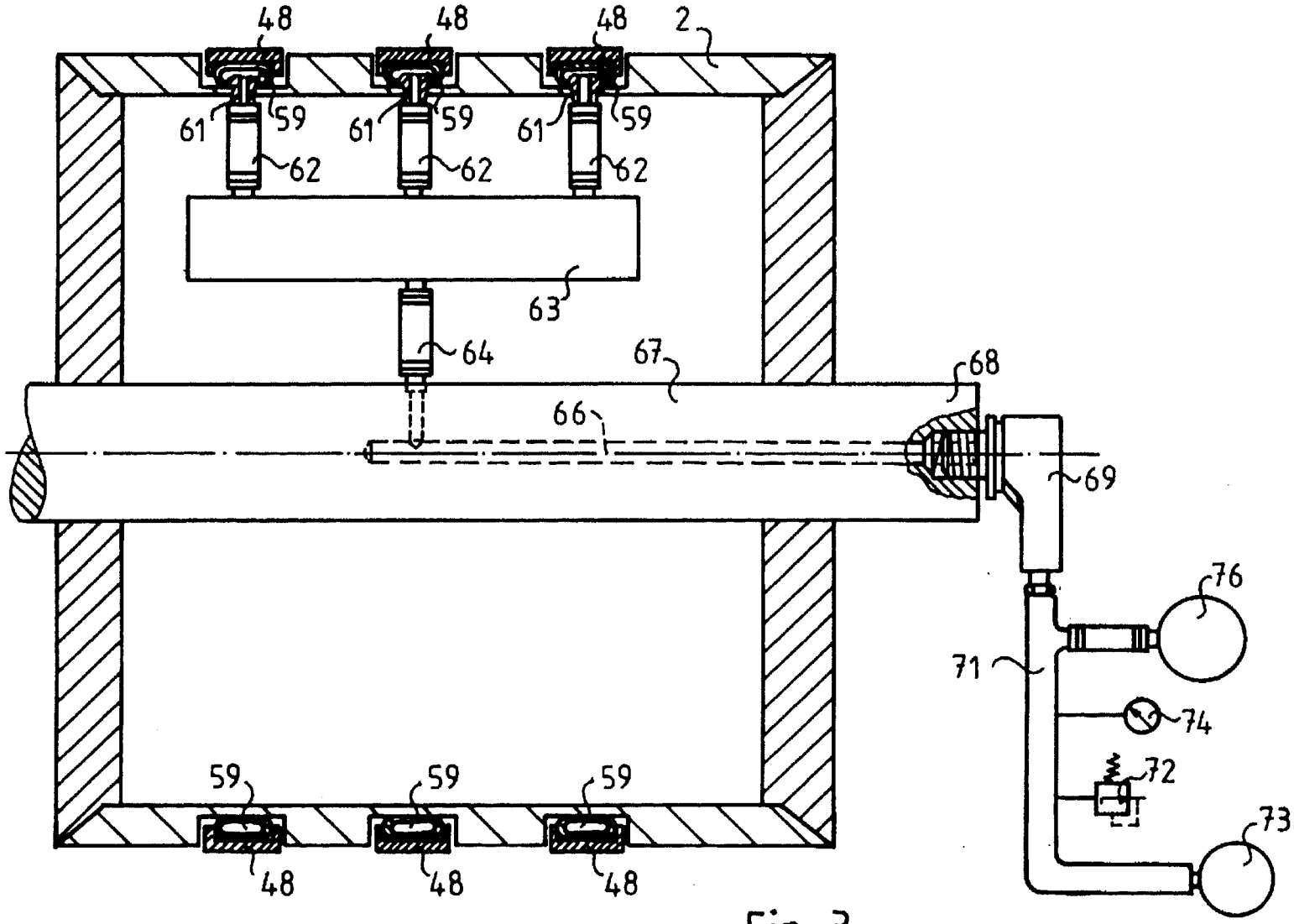
FIG. 3 is a schematic cross-sectional view of the collection and cutting cylinder and showing the use of compressed air to change the circumference of the cylinder.

Referring now primarily to FIGS. 2 and 3 there may be seen one of the controlled point spur sets 10 and one of the cutter bars 4 in connection with a device for increasing the circumference of the collection and cutting cylinder 2. A plurality of adjacent, generally arcuate shaped support hoops 48 are disposed on the circumferential surface 46 of the collection and cutting cylinder 2 respectively between two sets of points 47 for two point spur sets 10 and 11. The support hoops 48 are each situated in a groove 49 which is sufficiently deep so that the support hoops 48 can be retracted below the circumference 46 of the collection and cutting cylinder 2. Two open sleeves or bushings 52 for each support hoop 48 are aligned in the direction of the cylinder center and are welded to the groove bottom 51 of the groove 49 at a distance from each other. A compression spring 53 is disposed in each bushing 52, and abuts against a radially outer bushing bottom 54. The force of each spring 53 acts on a head 56 of a screw 57 having a shank. The screw 57 extends, starting at the groove bottom 51 of the groove 49, through the bushing bottom 54 and is screwed into the support hoop 48. The screw 57 and spring 53 thus pull the hoop 48 into the groove 49. An enclosed chamber 59 of changeable volume, which is formed by a circular hose, for example of plastic, and which is closed at both ends, is provided in a space 58 between the underside of the support hoop 48 and the groove bottom 51. Each hose, which comes to rest at a place between the two bushings 52, is provided with a connecting stem 61. Each connecting stem 61 is connected through a connecting tube or a hose 62 with a compressed air reservoir 63 that is located within the cylinder 2. The compressed air reservoir 63 can be disposed inside or outside of the collection and cutting cylinder 2. A transition tube or a hose 64 extends radially inwardly from the compressed air reservoir 63 toward the longitudinal center of a shaft 67 of the collection and cutting cylinder 2 and is coupled to a blind bore 66. One shaft end 68 of the shaft 67 is provided with a rotor connection 69. The blind bore 66 is connected with a compressed air source 73 through the rotor connection 69 by a tube 71 and an intervening pressure control valve 72. A pressure gauge 74 is connected to the supply line or the tube 71 between the pressure control valve 72 and the shaft end 68. An external compressed air reservoir 76 can be connected to the tube 71 between the rotor connection 69 and the pressure gauge 74.

If the hoses 59 are supplied with little or no compressed air pressure, the support hoops 48, which are acted upon by the compression springs 53, press these hoses 59 flat. When the hoses are charged, for example with compressed air, the hoses 59 are expanded and the support hoops 48 are pushed radially outwardly in accordance with the amount of the air pressure. The air pressure can be regulated within narrow tolerances by means of the pressure control valve 72.

If the paper tension between the last driven pair of drawing rollers 43 and 44 and the collection and cutting cylinder 2 is greater than the tension set by the pressure control valve 72, the paper web 42 presses against the support hoops 48. As a result of this pressure, the hoses 59 are compressed and the air pressure in the hoses 59, in the supply lines 62, 64, 66, 69 and 71, and in the compressed air reservoirs 63 and 66 is increased. If now the interior pressure exceeds the set pressure, the pressure control valve 72 releases pressure until the set air pressure has been reached. Now the support hoops 48 are allowed to contract to a decreased radius, so that the tension of the paper web between the points 47 of the point spur sets on the cutting cylinder 2 and the last pair of drawing rollers 43, 44 is also decreased. It is of course possible to provide other machine elements which can be displaced under pressure, such as diaphragm cylinders or air pistons, in place of the hoses 59.

This arrangement of adjustable support hoops 48 for use in changing the circumference of the collection and cutting cylinder 2 is also applicable to the folding blade support 21 of the folding, point spur and counter-cutting-bar cylinder assembly 16, so that an almost constant tension is achieved in the paper web train 42, regardless of its changes in thickness.

The distance or lateral spacing between the folding rollers 36 and 37 can be set by means of a gear motor 77. The folding rollers 36 and 37 have teeth on their respective surfaces, which move synchronously with respect to each other as if they were in meshing engagement, but which are kept at a distance of the depth of one tooth and in addition maximally one thickness of the product from each other. This arrangement has the advantage that a transfer of the ink within the folded product and smearing of the ink on the outer pages does not occur. Together with the setting of the folding roller gap, an adjustment of the elevation of the elevator 41 in accordance with the changed height of the folded products in the scale-like flow takes place by means of the same drive. In the process, a ratio of 1:4 to 1:6 applies between the thickness of the folded product and the elevation of the elevator 41 under the paddles of the paddle wheel 38.

Viewed in the direction of rotation of the folding, point spur and counter-cutting-bar cylinder assembly 16 which is rotating in a clockwise direction, a brush roller 78 is supported on the side frame, downstream of the second folding roller 37 and acts as a pressure device for the signatures to keep the signatures against the peripheral surface of the folding cylinder assembly 16 after the signatures have been released by the point spurs 17–20. This brush roller 78 in carried on a shaft which is driven by the main drive and has a roller or disks on the shaft which are driven by pinion gears. The periphery of the roller or the disks is covered either completely or partially with bristles or any other soft material. The direction of rotation of the brush roller 78 is opposite to that of the folding, point spur and counter-cutting-bar cylinder 16 and the peripheral speed of the brush roller is up to 30% greater than that of the folding, point spur and counter-cutting-bar cylinder assembly 16. This brush roller 78 operates to maintain an appropriate guidance and tautness of the signatures separated from the paper web train 42 even after the point spur sets 17 to 20 have been retracted. The proper folding of the signatures into folded products is made possible by operation of this brush roller 78 even at high production speeds. The brush roller 78 is preferably provided with bristles or the like only over half its periphery and is synchronized with the folding blades 27 to 30 in such a way that the side of the brush roller 78 which is free of bristles faces the folding, point spur and counter-cutting-bar cylinder assembly 16 at the time the signatures are pulled back opposite to the direction of rotation of the cylinder assembly 16, as occurs during the transverse folding process. The distance between the brush roller 78 and the folding, point spur and counter-cutting-bar cylinder 16 can be set as a function of the thickness of the signatures by an appropriate adjustable support assembly which is not specifically shown.

The collection and cutting cylinder 2 and the folding, point spur and counter-cutting-bar cylinder assembly 16 are partially surrounded by paper guide devices 79. These paper guide devices 79 can, for example, consist of bars adapted to the jacket surface of the collection and cutting cylinder 2 as well as to the jacket surface of the folding, point spur and counter-cutting-bar cylinder assembly 16.

The passage of the paper web train 42 through the cylinder folding apparatus of the present invention takes place in a manner as will now be described. The paper web train 42 is brought to the collection and cutting cylinder 2 by the drawing roller group 43 and 44. When the collection and cutting cylinder 2 rolls off on the folding, point spur and counter-cutting-bar cylinder assembly 16, the incoming paper web train 42 is penetrated by one of the point spur sets 17 to 20 on the folding cylinder. A roller 98, that is attached to the side frame and which is disposed before and above or ahead of the penetration line of these point spur sets 17 to 20 into the paper web train 42, prevents the deflection of the paper web train 42. As may be seen in FIG. 1, this anti-deflection roller 98 is situated in the inlet wedge above and between the point of convergence of the cutting cylinder 2 and the folding cylinder 16. The paper web train 42 is cut into signatures by means of one of the cutter bars 4 to 8, which are disposed on the collection and cutting cylinder 2, and one of the counter-cutting bars 22 to 25, which are located on the folding, point spur and counter-cutting-bar cylinder assembly 16. During double production, these signatures are next taken over by one of the point spur sets 17 to 20 of the folding, point spur and counter-cutting-bar cylinder assembly 16 and are brought to the folding rollers 36, 37. As each signature approaches the folding rollers 36 and 37 its associated point spur set starts to retract out of the signatures at approximately 20° ahead of the folding time, and the brush roller 78 takes over product guidance. The paper guide devices 79 continue to guide the folded products to the paddle wheel 38. From there, the folded products are brought to the elevator 41 by means of the removal chain 39. The removal chain 39 is equipped with a number of fingers on its circumference which, as they roll off the paddle wheel 38, push the folded products out of the paddles of the paddle wheel 38. During collection production, the first section of the signatures is collected on, and is guided around the collection and cutting cylinder 2. In the course of the second rotation of the cutting cylinder 2, the second and first sections of the signatures are taken over from the cutting cylinder 2 by the point spur sets 17 to 20 on the folding blade cylinder assembly 16 and are guided to the folding rollers 36, 37. Here, too, the retraction of the point spur set takes place 20° ahead of the folding time, and the brush roller 78 takes over product guidance until the return or draw-in of the folded product into the folding rollers 36 and 37.

While a preferred embodiment of a cylinder folding apparatus for a rotary printing press in accordance with the present invention has been set forth fully and completely hereinabove, it will be apparent to one of skill in the art that a number of changes in, for example, the overall sizes of the cylinders, the drive assemblies for the cylinders, the type of printing done on the paper webs and the like may be made without departing from the true spirit and scope of the present invention which is accordingly to be limited only by the following claims.

What is claimed is:

1. A cylinder folding apparatus for a rotary printing press comprising:

a collection and cutting cylinder having a first number of peripherally spaced first sections with each of said first sections having peripherally spaced first controlled point spur sets and paper web cutting devices usable to cut a paper web into a plurality of signatures;

a folding cylinder assembly including a folding cylinder having a second number of peripherally spaced second sections in cooperative engagement with said collection and cutting cylinder, said folding cylinder second sections each having peripherally spaced second controlled point spur sets and counter-cutting bars, and a folding blade support provided with rotating folding blades, said folding cylinder having a solid body, said first number of first sections being one greater than said second number of second sections, said folding cylinder assembly being operable to transversely fold signatures cut by said paper web cutting devices;

spaced folding rollers positioned adjacent said folding cylinder assembly and after, in a direction of rotation of said folding cylinder assembly, said collection and cutting cylinder, said folding rollers receiving folded signatures from said folding cylinder assembly;

a paper web train anti-deflection roller positioned upstream in a direction of paper web train travel of said collection and cutting cylinder and said folding cylinder assembly, in an inlet wedge defined by said collection and cutting cylinder and said folding cylinder assembly, said anti-deflection roller being positioned to prevent deflection of a paper web being pierced by said second point spur sets on said folding cylinder;

a brush roller positioned after, in the direction of rotation of said folding cylinder assembly, said spaced folding rollers, said brush roller being rotated in a direction opposite to said direction of rotation of said folding cylinder assembly and at a circumferential speed of rotation greater than that of said folding cylinder assembly, said brush roller having a surface engageable with signatures on said folding cylinder and being operable to hold signatures on said folding cylinder after disengagement of said second controlled point spur sets from a signature and prior to receipt of a folded signature by said folding rollers;

a plurality of circumferentially extending hoop sections positioned in grooves on a peripheral surface of said collection and cutting cylinder, and means to move said hoop sections radially inwardly and outwardly to change a circumferential size of said collection and cutting cylinder; and means for varying a distance between each said folding blade in said folding blade support and said second controlled point spur set and counter-cutting bar in each of said spaced second sections of said folding cylinder.

2. The cylinder folding apparatus of claim 1 wherein said means to move said hoop sections radially outwardly are inflatable hoses positioned beneath said hoop sections in said grooves, said inflatable hoses being connectable to a source of compressed gas.

3. The cylinder folding apparatus of claim 1 wherein said means to move said hoop sections radially inwardly are compression springs positioned in sleeves secured to said grooves and screws received in said hoop sections and passing through said compression springs, said compression springs exerting a radially inwardly directed force on said screws.

* * * * *